US006854692B1

(12) United States Patent
Winkel

(10) Patent No.: US 6,854,692 B1
(45) Date of Patent: Feb. 15, 2005

(54) SWIVELLING GUTTER SUPPORT AND INSTALLATION METHOD

(76) Inventor: Brandon J. Winkel, 3415 Oriole SW., Wyoming, MI (US) 49509

( * ) Notice: Subject to any disclaimer, the term of this patent is extended or adjusted under 35 U.S.C. 154(b) by 82 days.

(21) Appl. No.: 10/365,454

(22) Filed: Feb. 13, 2003

(51) Int. Cl.[7] ..... E04D 13/064
(52) U.S. Cl. ..... 248/48.1; 52/11; 248/48.2
(58) Field of Search ..... 248/48.1, 48.2; 52/11, 16, 15

(56) References Cited

U.S. PATENT DOCUMENTS

| | | | | | |
|---|---|---|---|---|---|
| ,057,813 | A | | 9/1866 | Yapp | |
| ,084,467 | A | | 12/1868 | Arter | |
| D3,504 | S | | 5/1869 | Wadsworth | |
| ,171,915 | A | | 1/1876 | Burdoin | |
| ,181,731 | A | | 8/1876 | Shipley | |
| ,290,731 | A | | 12/1883 | Bear et al. | |
| ,384,985 | A | | 6/1888 | Laurence | |
| ,390,122 | A | | 9/1888 | Green | |
| ,465,166 | A | | 12/1891 | Davidson | |
| ,670,675 | A | | 3/1901 | Karpenstein | |
| ,716,841 | A | | 12/1902 | Jacoby | |
| 1,000,411 | A | | 8/1911 | Hyke, Sr. | |
| 2,635,841 | A | | 4/1953 | Bauhammer et al. | |
| 3,426,987 | A | | 2/1969 | Leslie | |
| 3,752,428 | A | | 8/1973 | Trostle et al. | |
| 4,169,570 | A | | 10/1979 | Morin | |
| 4,210,301 | A | | 7/1980 | Weiss | |
| 4,241,548 | A | | 12/1980 | Rowe | |
| D314,815 | S | | 2/1991 | Paulsson | |
| 5,046,692 | A | | 9/1991 | Nicholas | |
| 5,649,681 | A | * | 7/1997 | Faye | 248/48.1 |
| 5,884,876 | A | * | 3/1999 | Axford | 248/48.2 |
| 6,168,125 | B1 | | 1/2001 | Winger et al. | |
| 6,389,755 | B1 | | 5/2002 | Wenner | |
| 6,631,587 | B2 | * | 10/2003 | Lynch | 52/11 |

FOREIGN PATENT DOCUMENTS

| | | | | | |
|---|---|---|---|---|---|
| JP | 01190865 | A | * | 7/1989 | E04D/13/06 |
| JP | 06200600 | A | * | 7/1994 | E04D/13/06 |
| JP | 06235249 | A | * | 8/1994 | E04D/13/06 |
| JP | 06257261 | A | * | 9/1994 | E04D/13/06 |
| JP | 08165765 | A | * | 6/1996 | E04D/13/072 |
| JP | 10-37414 | | | 2/1998 | |
| JP | 2002115378 | A | * | 4/2002 | E04D/13/072 |

* cited by examiner

*Primary Examiner*—Leslie A. Braun
*Assistant Examiner*—A. Joseph Wujciak
(74) *Attorney, Agent, or Firm*—Tom Hamill, Jr.

(57) ABSTRACT

A swiveling gutter support or bracket is provided to be used to hang and support conventional existing gutters. The gutter support, when affixed to the gutter, keeps the gutter open as well as secured to the building sidewall. The gutter support has a first portion, an intermediate portion and a second portion. The first portion is adapted to be received within the gutter lip. The intermediate portion connects the first portion to the second portion and includes a swivel. In some configurations, especially using plastics, the first portion may be directly molded to the second portion, and the two portions would be able to rotate. The swivel connects the first portion to the second portion. The swivel also permits the second portion to rotate with respect to the first portion. Once rotated, the second portion aligns with the side of the house. An aperture is provided on the second portion structure. The aperture is adapted to receive a fastener such as a nail, screw or the like there through. The nail will pass through the second portion, through the flashing which is in contact with the building sidewall, and into the building sidewall securing the gutter support thereto. The swivelling gutter support may be made from metal, plastic or other material which has sufficient material properties.

5 Claims, 6 Drawing Sheets

10
12
14
15
16
24
25
28
30
32
34
38
40
44
46
A
3
3

SWIVELLING GUTTER SUPPORT AND INSTALLATION METHOD

BACKGROUND OF THE INVENTION

1. Field of the Invention

The present invention relates to mounting or support devices and more particularly to a gutter mount which swivels or pivots about a generally central point to permit more efficient installation.

2. Description of the Prior Art

Devices to support gutters onto the sidewall of a structure are known. They may be separated into two general types. The first type is a gutter support which hold or supports the gutter from the outside of the gutter proper. This support surrounds the exterior of the gutter and the gutter actually lies in a plurality of such supports. These supports can be easily seen from the ground. The second type is adapted to fit inside the gutter, keeping the gutter open while keeping the gutter secured to the sidewall. These gutter hangers may be known as "hidden hangers". These prior art gutter supports are of a specific length and include a first end and a second end. The first end is supported in the lip of the gutter and the second end includes an aperture through which a nail or the like passes through securing the gutter mount, and hence the gutter, to the sidewall of the structure. Again, this mount is secured across the top of the interior of the gutter and cannot be seen from the ground. The prior art "hidden hangers" have several drawbacks. They are nearly impossible to install without damaging the front lip of the gutter, the drip edge or the shingles themselves on a pre-existing gutter application.

Although the prior art indicates it to be known to use support devices to mount a gutter to a sidewall, the provision of a swivelling or pivotable gutter mount is not taught. The instant invention resides inside the gutter proper, and also cannot be seen from the ground. This will be shown in the figures. Additionally, the prior art does not teach a first portion of the swivelling gutter support being adapted to fit into the lip of the gutter, and then swivelling the second portion of the swivelling gutter support against the side of the sidewall of the structure, where a fastener would secure the support to the sidewall proper. The new gutter support is more easily and efficiently applied than the prior art devices. The instant device due to its rotation, misses flashing, terminus of the roofing material, and other structure permitting ease of installation. The instant invention does not damage existing roof and gutter structure. Although the instant swivel bracket or mount is designed to shore up pre-existing gutter systems, they may be employed to mount a new gutter system if desired. Other advantages of the instant invention will be shown in the specification, figures and claims.

SUMMARY OF THE INVENTION

The present invention provides a swiveling gutter support to be used to hang and support conventional gutters. Although the instant swivel support (brace or bracket) mount is designed to shore up pre-existing gutter systems, they may be employed to mount a new gutter system if desired. The gutter support, when affixed to the gutter, keeps the gutter open as well as secured to the building sidewall. By the ability of the swiveling gutter support to rotate generally about its center to install, damage to the gutter and roof is eliminated. The gutter support has a first portion, an intermediate portion and a second portion. The first portion is adapted to be received within the gutter lip. The intermediate portion connects the first portion to the second portion and includes a swivel. The swivel connects the first portion to the second portion. The swivel also permits the second portion to rotate with respect to the first portion. Once rotated, the second portion aligns with the side of the house. An aperture is provided on the second portion structure. The aperture is adapted to receive a fastener such as a nail, screw, connecting flange, fastening flange or the like there through. The nail will pass through the second portion, through the flashing which is in contact with the building sidewall, and into the building sidewall securing the gutter support thereto. The swivelling gutter support may be made from metal, plastic or other material which has sufficient material properties.

A gutter is a generally U-shaped channel with two sidewalls and a bottom which connects the first sidewall to the second sidewall. In modern gutters, a lip is formed on the top of the first sidewall. The first sidewall additionally angled away from the building or structure wall. The second sidewall, when mounting, would be placed directly parallel the wall of the building, underneath a piece of roof flashing.

The swivelling gutter mount would be placed in between the top of the first sidewall and the top of the second sidewall. In order to install the swivelling gutter mount, the first portion of the mount remains straight while the second portion is swivelled or pivoted to be in a ninety degree relation to the first portion of the gutter mount. The first portion of the swivelling gutter mount has a C-shaped element at the first end opposite the connecting swivel. This C-shaped element is adapted to fit inside the lip of the gutter. First, the C-shaped portion engages the lip with the first portion of the swivelling gutter mount is vertical. Then, the first portion is brought down to a horizontal position. This firmly engages the gutter mount to the lip of the gutter. Then, the second portion is swivelled or pivoted ninety degrees. This brings the second portion of the swivelling gutter mount into proximal relation to the wall to which the gutter is being affixed. The second portion has a mounting portion which includes an aperture. A fastener is placed through the aperture thus securing the swivelling gutter mount to the wall of the structure to which the gutter is being affixed. This in turn affixes the gutter to the wall of the structure. The precise structural configuration of the swivelling gutter mount and gutter will be better seen in the figures and described in detail in the detailed description of the drawings.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is an object of the present invention is to provide gutter mount which swivels or pivots about its center.

It is an object of the present invention to provide a gutter mount with a first portion and a second portion, the second portion pivotably connected to the first portion.

It is an object of the present invention to provide a gutter mount with a swivel or pivot which includes a detent or other means to keep the mount in it's elongated position.

It is an object of the present invention to provide a gutter mount with a first portion, the first portion having a generally c-shaped element on it's first side, the first portion further having a swivelling or pivotable connection means on it's second side, which swivallably or pivotably connects the first portion second side to the second portion second side (and visa versa).

It is an object of the present invention to provide a gutter mount with a second portion, the second portion having a mounting element with aperture on it's first side, the second portion further having a swivelling or pivotable connection means on it's second side, which swivallably or pivotably connects the second portion second side to the first portion second side (and visa versa).

It is an object of the present invention to provide a gutter mount which may be used to repair or shore-up existing rain gutter systems.

It is an object of the present invention to provide a gutter mount which may strengthen existing rain gutter systems, without damaging the proximal roof structure such as shingles, roof or flashing.

It is an object of the present invention to provide a gutter mount which adapts to situation where conventional non-rotatable gutter hangers will not work.

It is an object of the present invention to provide a gutter mount which due to the ease of installation decreases the amount of time required to install.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, the preferred embodiments of the invention embodying the principles and concepts of the present invention will be described.

Figure 1:
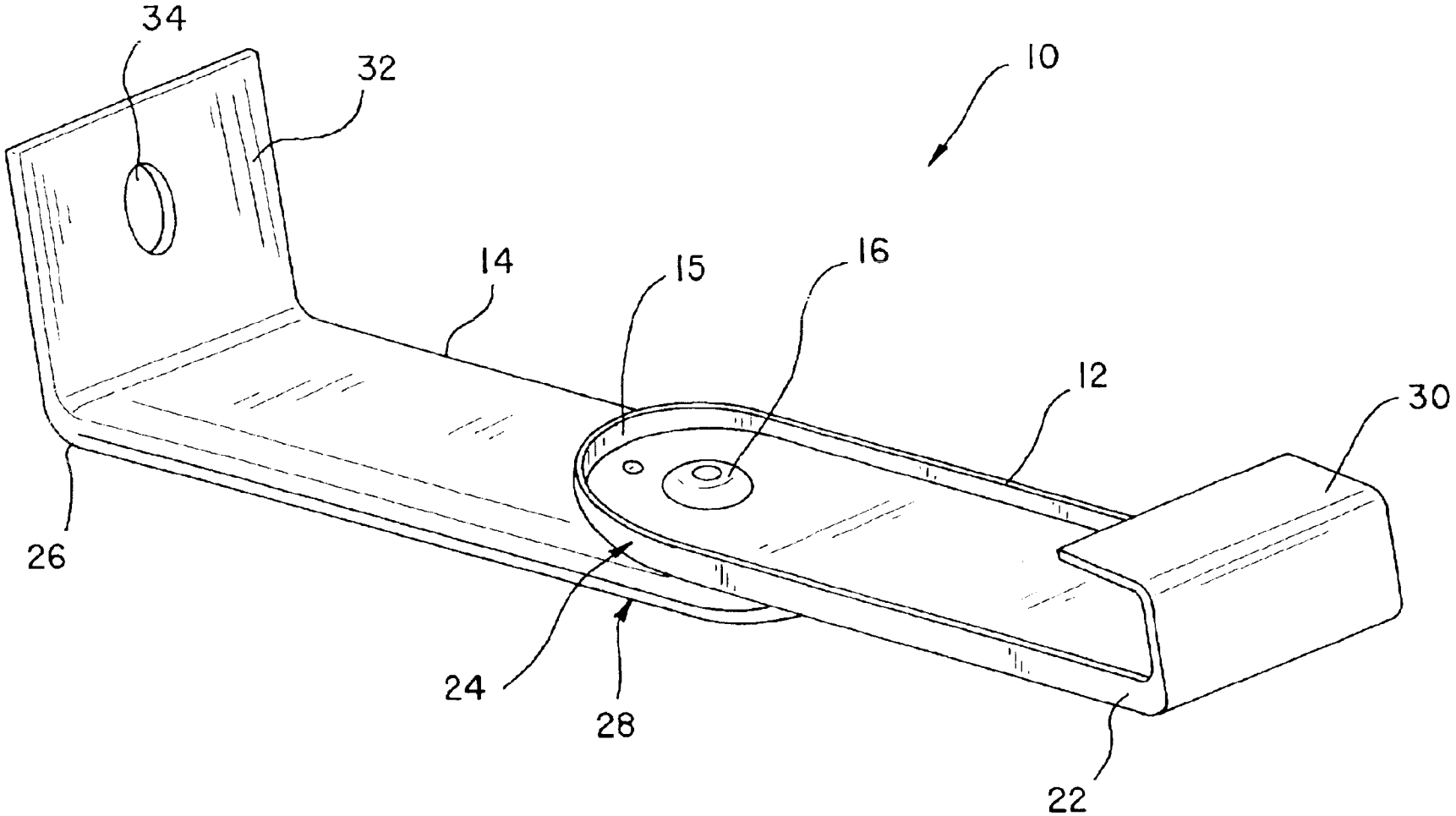
FIG. 1 is a perspective view of the swivelling hanger bracket which is adapted to affix rain gutter systems to the side of buildings or structures.

Turning initially to FIG. 1, there is shown the swivelling hanger 10. The swivelling hanger 10 includes a first portion 12 and a second portion 14. The first portion 12 is rotatably connected to the second portion 14 by pivot pin 16. This permits both the first portion 12 and the second portion 14 to swivel about pin 16.

The first portion 12 has a first side 22 and a second side 24. The second portion 14 has a first side 26 and a second side 28. The first portion 12 second side 24 is rotatably connected to the second portion 14 second side 28 by the pivot pin 16.

The first portion 12 first side 22 ends in a generally c-shaped element 30. The first portion 12 first side 22 is integral with the generally c-shaped element 30 as shown. The generally c-shaped element 30 is adapted to be received in the underside of the lip portion of the gutter, which will be better seen in FIG. 7. This c-shaped element 30 interfits into the underside of the lip portion of the gutter in a sliding fashion, once fully inserted into the gutter, the c-shaped element 30 will remain there until removed. The first portion 12 second side 24 ends in a generally half-circular arc 15 with aperture 38 (best seen in FIG. 6) being the approximate center.

The second portion 14 first side 26 ends in an end piece 32. End piece 32 is generally rectangular as shown and includes a centrally disposed aperture 34. The end piece 32 is substantially perpendicular as well as integral with the second portion 14 first side 26. The second portion 14 second side 28 also ends in a generally half-circular arc 25 with aperture 40 (best seen in FIG. 5) being the approximate center. The centrally disposed aperture 34 is designed to receive a fastener (best seen in FIG. 7) there through, securing the swivelling hanger 10 to the wall of a structure (also best seen in FIG. 7). Any fastener may be used, including, but not limited to, nails, screws or rivets. The fasteners may be manufactured from plastic, metals or composites.

Figures 2, 3, 4, 5, 6:
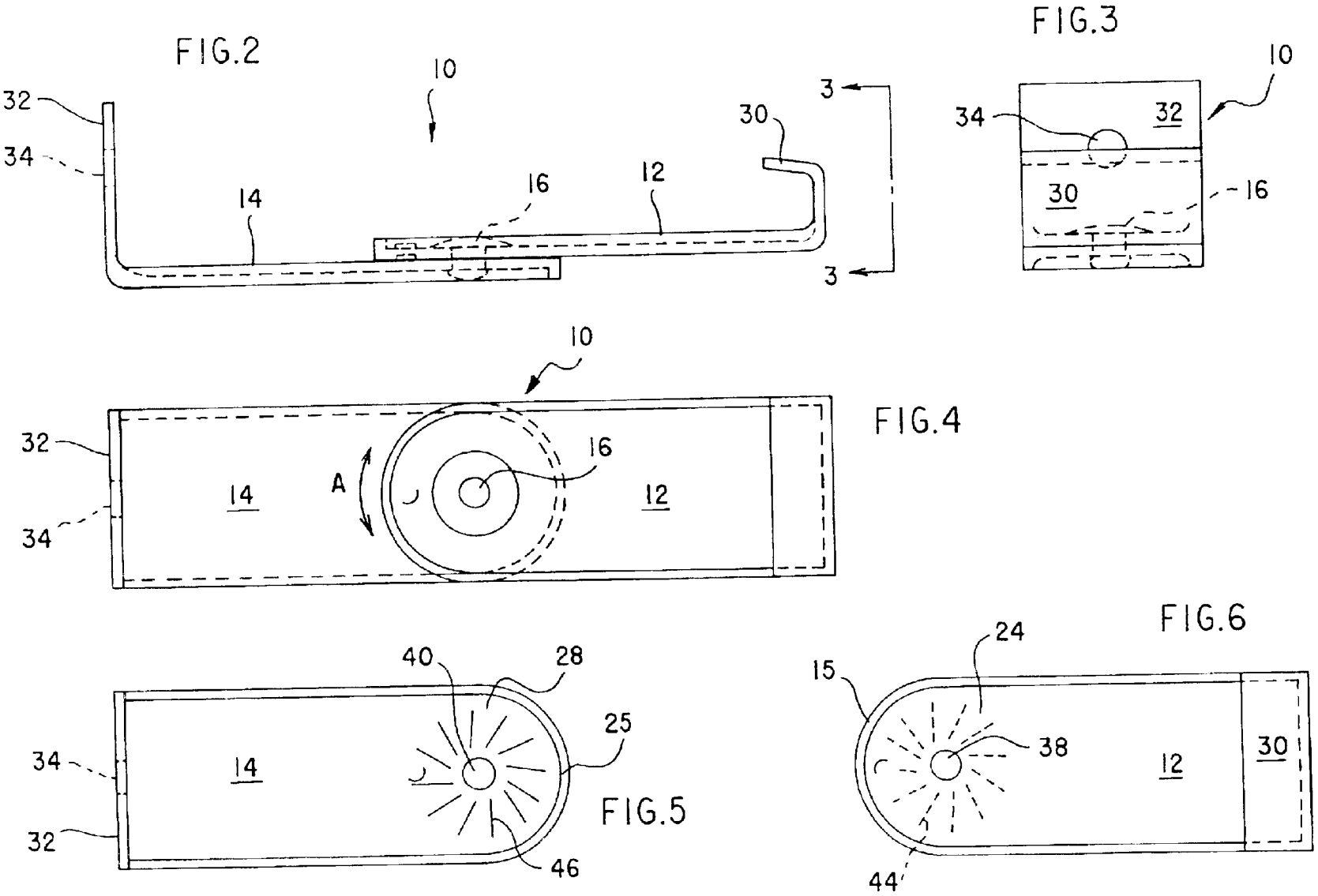
FIG. 2 is a side view of the swivelling hanger bracket.
FIG. 3 is an end view taken along line 3—3 of FIG. 2 of the swivelling hanger bracket.
FIG. 4 is a top view of the swivelling hanger bracket.
FIG. 5 is a top view of the second portion of the swivelling gutter bracket shown detached.
FIG. 6 is a top view of the first portion of the swivelling gutter bracket shown detached.

FIGS. 2–4 reflect different views of the swivelling hanger 10. FIG. 2 shows a side view of the swivelling hanger 10. FIG. 3 shows an end view of the swivelling hanger 10 as seen from line 3—3 in FIG. 2. FIG. 4 shows a top view of the swivelling hanger 10. Reference Letter A designates an Arrow which shows the capability of the swivelling hanger 10 to rotate about pivot pin 16. This rotation is one of the essential elements to mounting the swivelling hanger 10 onto a gutter. It is also to be understood the swivelling hanger 10 may be made from any of a variety of materials. These include, but are not limited to, steel, aluminum, stainless steels, steel alloys, other metals and alloys and any of a variety of plastics. Other materials may be used which have sufficient material properties to perform the function of holding the weight of the gutter.

FIGS. 5 & 6 shows the swivelling hanger 10 sans pivot pin 16. The first portion 12 second side 24 includes a first pin receiving aperture 38. The second portion 14 second side 28 includes a second pin receiving aperture 40. The first portion 12 includes a plurality of first frictional elements 44. The second portion 14 includes a plurality of second frictional elements 46. When the second portion 14 is rotated about the first portion 12, the plurality of first frictional elements 44 coact with the plurality of second frictional elements 46. This has the effect of making the rotation precise as well as to permit the first portion 12 to remain in a desired angular relationship with the second portion 14.

Figure 7:
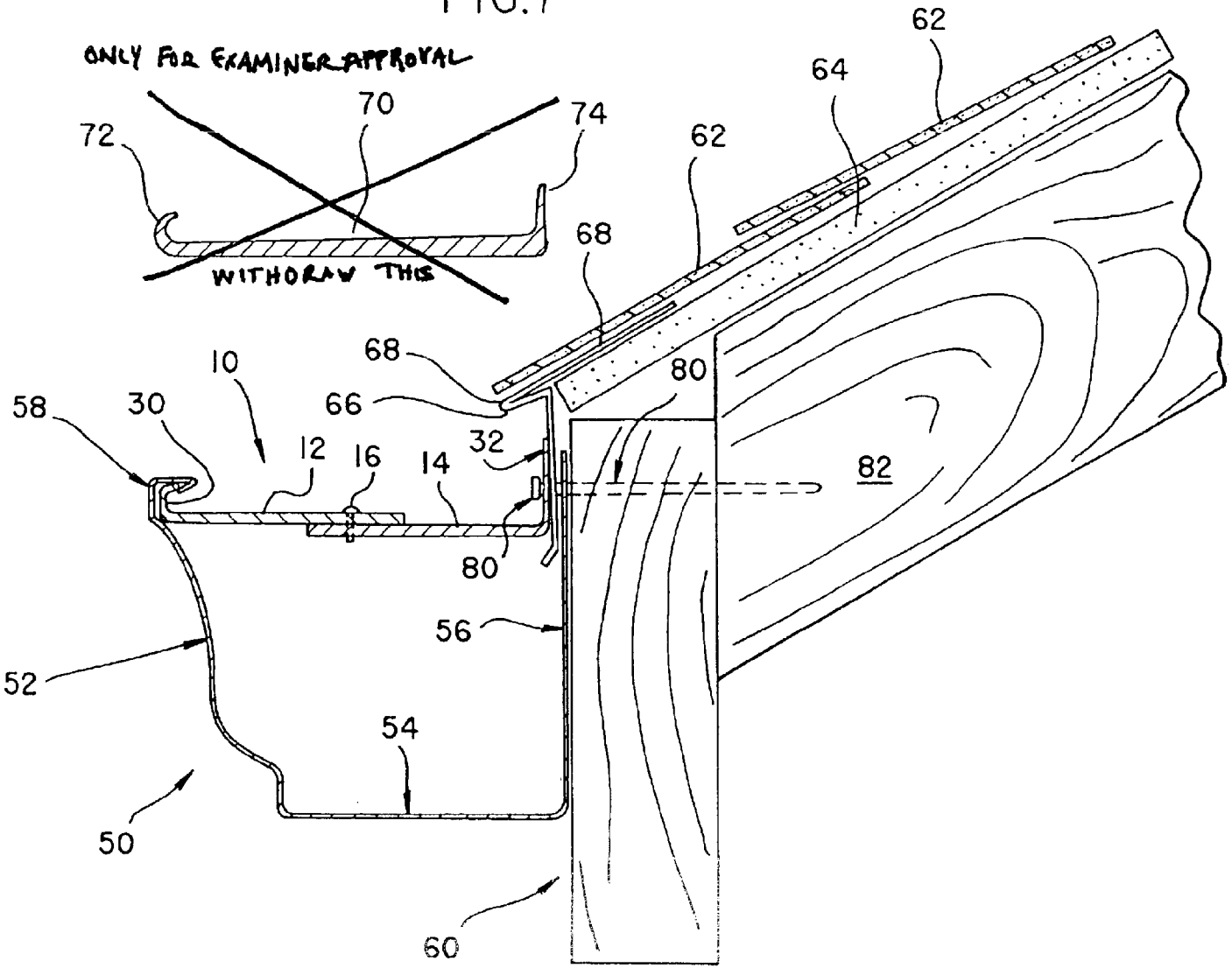
FIG. 7 discloses the swivelling gutter hanger being employed securing a gutter to the fascia of the structure.

Referring now to FIG. 7, a gutter 50. The gutter 50 is generally a U-shaped channel having an outer portion 52, a bottom portion 54 and a inner portion 56. Atop the outer portion 52 is the gutter lip 58. The inner portion 56 lies against the fascia 60. Roofing shingles 62 are shown secured to the roof 64 proper. The roofing shingles 62 extend over the roof 64 where they would lie atop the drip edge 66. The drip edge 66 may be considered to be a point on the flashing 68. As can be seen, the top of the gutter's 50 inner portion 56 lies intermediate the flashing 68 and the fascia 60.

The prior art gutter hanger would be placed where the instant invention 10 is shown. The prior art device is an integral device and does not swivel. It has a c-shaped element on a first side and a straight element vertical element on the second side. The drawbacks of such a device can easily be seen. To install, one must take the prior art device, orient it vertically, get the c-shaped element inside the gutter lip 58. This is difficult because of its length. At this point, the installer must pass the straight element over the roofing shingles 62, the flashing 68, especially where it extends to the drip edge 66. Once this is accomplished, a fastener would then secure the prior art device. It takes a skilled worker not to damage the roof and its elements and efficiently install the prior art device. Damaged roofing elements degrades the overall system and contributes to early replacement of fascia 68, flashing 68, shingles 62 and other components.

The swivel hanger 10 is shown installed in FIG. 7. The installation of the swivel hanger 10 of the invention is simple, efficient, and does not damage any of the roofing elements. Initially, the second portion 14 is pivoted to be about ninety degrees to the first portion 12. The c-shaped element 30 interfits into the gutter lip 58. During the placement of the c-shaped element 30, the entire swivel hanger 10 is brought down into the mouth of the gutter 50. Because the hanger is in its swivelled configuration, its length is too short to intersect with the roof 64, the roofing shingles 62, the flashing 68 or even the drip edge 66. At this point, the second portion 14 of the swivelling hanger 10 is rotated about pivot pin 16 to be essentially co-linear with the first portion 12 of the swivelling hanger. This brings the second portion's 14 end piece 32 flush against the flashing 68. A fastener 80 is then driven through the aperture 34 on the end piece 32, through the flashing 68, through the inner gutter 56, through the fascia 60 and into element 82. This has the effect of securing the gutter 50 without damaging any of the roof elements.

Figure 8:
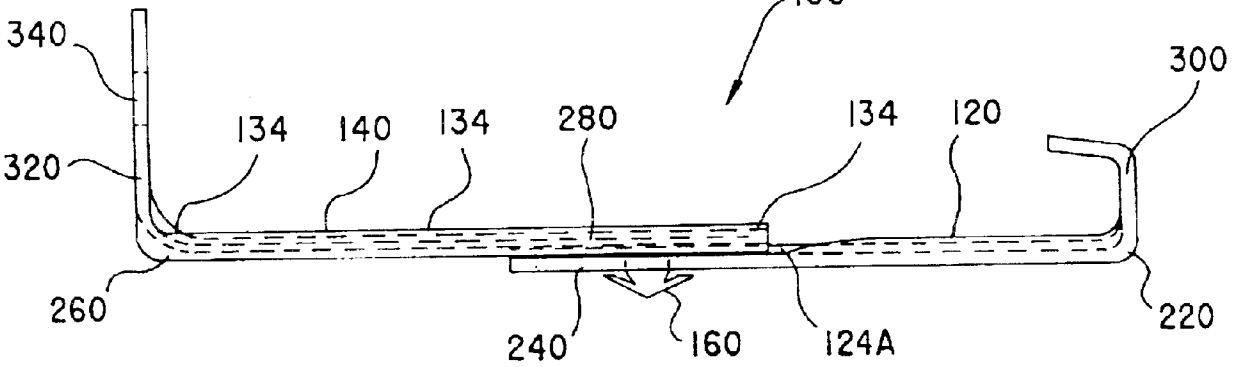
FIG. 8 discloses a second embodiment of the swivelling gutter hanger as seen in a side view.

Referring now to FIG. 8, a second embodiment of the swivelling gutter bracket 100 is shown. This gutter bracket 100 is preferably made from any of the multitude of plastics or metals commercially available. Gutter bracket 100 also has a first portion 120 and a second portion 140. The first portion 120 is rotatably connected to the second portion 140 by pivot pin 160. Both the first portion 120 and the second portion 140 may swivel independently or for that case in concert about pivot pin 160.

The first portion 120 has a first side 220 and a second side 240. The first portion 120 first side 220 is proximal a generally c-shaped element 300 and is integral with the first portion 120. The c-shaped element 300 is adapted to be received in the underside of the lip portion of the gutter, which can be seen in previous FIG. 7. The c-shaped element 30 interfits into the underside of the lip portion of the gutter in a sliding fashion, once fully inserted into the gutter, the c-shaped portion will remain fixed there until removed. The first portion 120 second side 240 ends in a generally half-circular arc 290 with aperture 152 being the approximate center.

The second portion 140 has a first side 260 and a second side 280. The second portion 140 first side 260 is proximal and integral with an end piece 320. End piece 320 is vertically oriented with respect to the second portion 140 first side 260. This vertical orientation creates an angle of about a ninety degrees between the end piece 320 and the second portion 140. The end piece 320 includes an aperture 340. The aperture 340 passes through the end piece 320 and is adapted to receive a fastener there through. The second portion 140 second side 280 ends in a generally half-circular arc 285 with aperture 154 being the approximate center.

Figure 9:
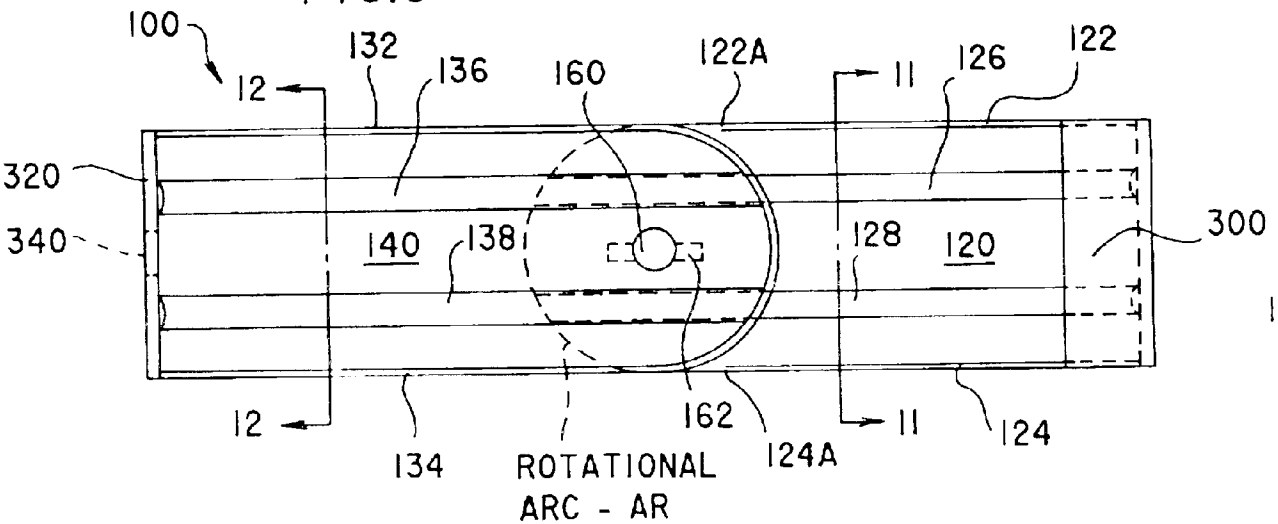
FIG. 9 discloses a second embodiment of the swivelling gutter hanger as seen in a top view.

Referring now to FIG. 9 a top view of the swivelling gutter bracket 100 is shown. Specifically looking at the first portion 120, a short right sidewall 122 and a short left sidewall 124 are shown. The short right sidewall 122 terminates at point 122A as shown. Also, the short left sidewall 124 terminates at point 124A as shown. Two parallel elongated detents (126 and 128 respectively) traverse the top side of the first portion 120.

Now, specifically looking at the second portion 140, a short right sidewall 132 and a short left sidewall 134 are shown. Both the short right sidewall 132 and the short left sidewall 134 extend about the entire length of the second portion 140. This is a different configuration than the short sidewalls found on the first portion 120, where the sidewalls on both sides terminate as shown at points 122A and 124A respectively. The sidewalls on the first portion 120 do not extend the entire length of the first portion 120, but only a fraction of that length. Additionally, two parallel elongated detents (136 and 138 respectively) traverse the top side of the second portion 140. Also shown is cutout slot 162. This permits any water which may gather on the top side of either the first portion 120 or second portion 140 to drain into the gutter, which, once the gutter bracket 100 is installed, would be located immediately below the bracket 100.

The rotational arc (AR) is also shown in FIG. 9. The second portion 140 lies atop the first portion 120 where pivot pin 160 secures both portions in such a manner where they may rotate about each other. The reason that the first portion 120 short right sidewall 122 and first portion 120 short left sidewall 124 do not extend the length of the first sidewall 120 is because if they did so, the rotation would not be able to take place. By terminating the first portion 120 short right sidewall 122 at point 122A and short left sidewall 124 at point 124A is to permit the second portion 140 to freely rotate without interacting with either sidewall on the top portion of the first portion 120.

Figure 10:
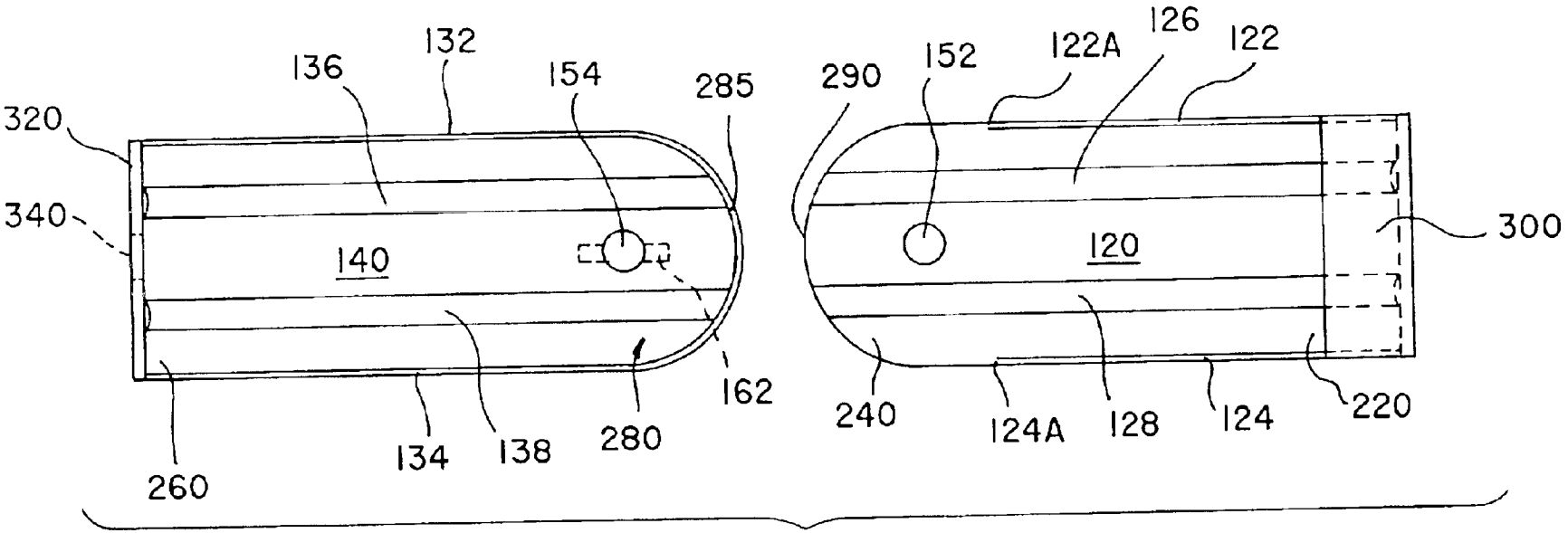
FIG. 10 discloses a second embodiment of the swivelling gutter hanger showing the first portion and the second portion disassembled.

Referring now to FIG. 10, the first portion 120 and the second portion 140 are shown disassembled. Aperture 152 passes through the first portion 120 as shown. Aperture 154 passes through the second portion 140 as shown. When the first portion 120 and the second portion 140 are mated together, the pivot pin 160 secures them together in a rotatable manner. The two parallel elongated detents (126 & 128) are adapted to lockingly interfit with the second pair of two parallel elongated detents (136 & 138). The discussion concerning the method of installation of the swivelling gutter hanger 100 will demonstrate how each of these elements are utilized.

Figure 11:
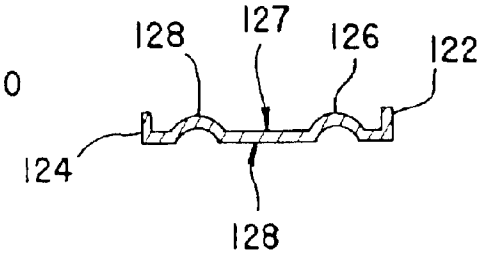
FIG. 11 discloses a cross-section of the second embodiment of the swivelling gutter hanger as seen from line 11—11 in FIG. 9.

FIG. 11 shows a cross-section of the first portion 120 of the swivelling gutter hanger 100 taken immediately about line 11—11 in FIG. 9. This shows the short right sidewall 122, the short left sidewall 124, and the two parallel elongated detents 126 & 128. The top 127 and bottom 128 of the first portion 120 is also shown. The cross-section shown in FIG. 11 is generally identical to a cross-section which would be formed at line 12—12 of FIG. 9. When the first portion 120 and the second portion 140 are not in linear alignment, they are able to easily rotate about the pivot pin 160. When the first portion 120 and the second portion 140 are in linear alignment, the two parallel elongated detents 126 & 128 have the second of two parallel elongated detents 136 & 138 nested atop of detents 126 & 128 within the area of the rotational arc AR.

Figure 12:
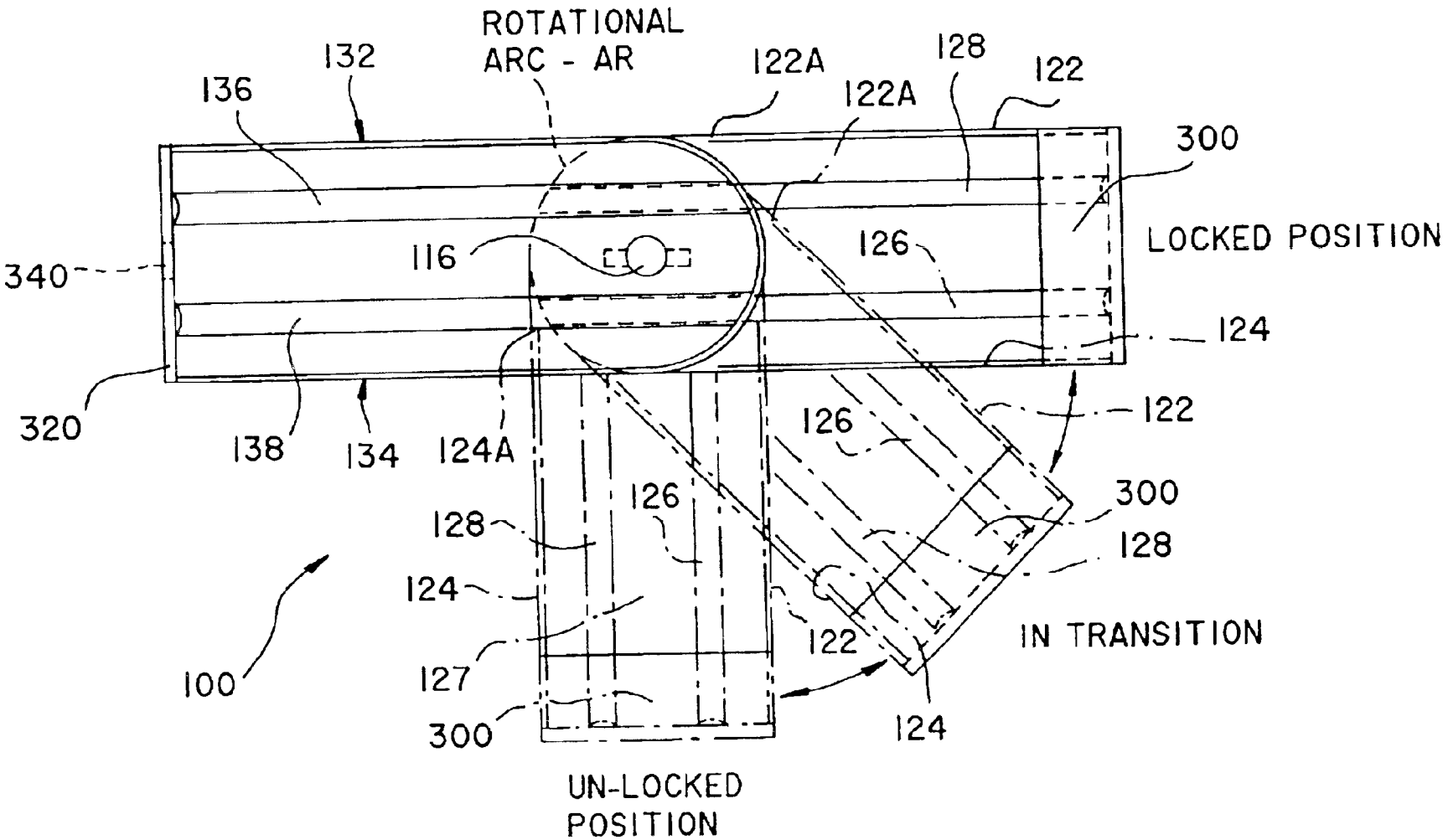
FIG. 12 shows the swivelling gutter hanger as it rotates or pivots about the centrally disposed pivot pin or barb.

Referring now to FIG. 12, the swivelling gutter bracket 100 is shown in transition from the un-locked position to the locked position. The sidewalls are sized to miss each other and the detents on the first portion 120 receive the detents on the second portion 140 in a nested relationship within the rotational arc which essentially locks the bracket 100 in the extended position. The installation is as described in paragraph [0042].

It is also understood that different mechanical structures or assemblies may be employed in the swivelling gutter mount which would also accomplish the same goal of not damaging preexisting gutter & roofing structure. Such devices may have a first portion and a second portion which include a slot in each portion to permit the two portions to inter-fit. Two or more slots may be provided which would permit the two portions to inter-fit. In yet another embodiment the mating elements of the two portions may be two c-shaped elements which inter-fit, thereby connecting them together. Even a central cutout on one portion which mates with a generally c-shaped element on the second portion has been considered. Other connection means may be employed as well.

It is apparent from the above that the present invention accomplishes all of the objectives set forth by providing a swivelling gutter mount which may be efficiently installed without damaging the gutter or any of the roof elements proximal to the gutter.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A bracket for attaching a gutter to a structure comprising, a first element, said first element having a first side, a second side, a top side and a bottom side, a second element, said second element having a first side, a second side, a top side and a bottom side, said first element second side rotatably connected to said second element second side, said first element second side has the shape of a half-circle and said second element second side also has the shape of a half circle, said first element includes a first detent in parallel relation to a second detent, said first detent and said second detent traverse essentially the length of said first element, said second element includes a third detent in parallel relation to a fourth detent, said third detent and said fourth detent traverse essentially the length of said second element, said first element first side includes an integral shaped element protruding from said first element top side and is further adapted to be received in a lip of said gutter, said second element first side includes an integral straight element protruding solely from said second element top side in a perpendicular fashion, said straight element being rectangular and including a centrally disposed aperture therethrough, whereby when said second element is rotated, said straight element is proximal to said structure and a fastener is passed through said centrally disposed aperture, securing the bracket to the structure.

2. A bracket for attaching a bracket to a gutter as claimed in claim 1 wherein said first element second side is connected to said second element second side by a pin.

3. A bracket for attaching a bracket to a gutter as claimed in claim 2 wherein when said second element is rotated, said third detent mates with said first detent and said fourth detent mates with said second detent.

4. A bracket for attaching a gutter to a building structure comprising, a first element, said first element having a first side, a second side, a top side and a bottom side, a second element, said second element having a first side, a second side, a top side and a bottom side, said first element second side rotatably connected to said second element second side, said first element second side has the shape of a half-circle and said second element second side also having the shape of a half circle, said first element first side includes an integral C-shaped element protruding from said first element top side and is further adapted to be received in a lip of said gutter, said second element first side includes an integral straight element protruding solely from said second element top side in a perpendicular fashion, said straight element being rectangular and including a centrally disposed aperture therethrough, whereby when said second element is rotated, said straight element is proximal to said structure and a fastener is passed through said centrally disposed aperture, securing the bracket to the structure.

5. A bracket for attaching a bracket to a gutter as claimed in claim 4 wherein said first element second side is connected to said second element second side by a pin.

* * * * *